United States Patent [19]

Bergh

[11] 4,236,466

[45] Dec. 2, 1980

[54] MECHANICAL ACTUATION OF FURNACE GRATE BEAMS

[75] Inventor: John C. Bergh, Elkhart, Ind.

[73] Assignee: Wheelabrator-Frye Inc., Hampton, N.H.

[21] Appl. No.: 83

[22] Filed: Jan. 2, 1979

[51] Int. Cl.[3] ..... F23H 7/08

[52] U.S. Cl. ..... 110/281; 110/291; 432/243; 198/774

[58] Field of Search ..... 198/768–770, 198/774; 110/228, 255, 257, 268, 281, 282, 289–291; 432/123, 134, 243, 244

[56] References Cited

U.S. PATENT DOCUMENTS

| | | | |
|---|---|---|---|
| 1,818,661 | 8/1931 | Weigel | 110/281 |
| 2,145,558 | 1/1939 | Santer et al. | 110/291 |
| 2,391,578 | 12/1945 | Lawrence | 110/291 |
| 3,713,631 | 1/1973 | Enk et al. | 432/243 |
| 3,749,550 | 7/1973 | Suydam | 432/243 |
| 3,863,578 | 2/1975 | Kato et al. | 110/257 |
| 3,985,084 | 10/1976 | Delaplace | 110/257 |

*Primary Examiner*—Henry C. Yuen

*Attorney, Agent, or Firm*—McDougall, Hersh & Scott

[57] ABSTRACT

A furnace for the conversion of trash and garbage into useful energy, in which use is made of a movable grating system over which the trash and garbage is advanced for passage through the furnace, the means for driving the grating being located outside of the furnace with a heat sink in between and which includes means for disconnecting the grating from the drive means without the need to gain access into the interior of the furnace.

7 Claims, 4 Drawing Figures

MECHANICAL ACTUATION OF FURNACE GRATE BEAMS

This invention relates to the conversion of garbage and trash into energy which can be utilized in the production of heat and/or electricity, while enabling the recovery of valuables, such as metals, from a residue that can be safely disposed without exceeding environmental standards for air, water and land.

The described features have been made available in a facility constructed in the United States for conversion of trash and garbage at a rate of 1600 tons per day into thermal energy in the form of steam which is utilized by an adjacent power plant for the production of electricity. A flow diagram of the operating facility is shown in FIG. 1 of the drawings, in which trash and garbage collected from adjacent communities is carried by truck 10 to an unloading dock 12 and dumped into a bunker 14.

The refuse is lifted from the bunker by a bucket 16 of a crane 18, which transfers the refuse to a feed hopper 20 from which the refuse is fed by a vibratory conveyor 22 onto a short feed chute 24 for introducing the refuse into the furnace 26. The refuse in the chute 24 forms an air seal between the interior of the furnace and the outside atmosphere for blocking the escape of heat and fumes from the furnace. This feed chute is water cooled to avoid ignition of the refuse in this area.

The refuse proceeds into and through the furnace over a series of downwardly inclined grates vertically spaced one below the other with a slight overlap between the trailing end of the upper grate and the leading end of the lower grate for continuous flow from one grate to the other through the furnace. The uppermost grate 30 is a drying grate having a length of about 7 feet, the intermediate grate 32 is a burnout grate having a length of about 15 feet whereon most of the combustion of the combustible refuse takes place, and the lowermost grate 34 is the riddling grate havng a length of about 15 feet where burning of the refuse still takes place but at a much slower rate. The vertical spacing (about 4 feet) between the grates serves to turn and loosen the refuse as it falls from one grate to the other, thereby to achieve more complete combustion. In the preferred practice, the grate 30 is omitted and the grate 24 becomes the drying grate, with the trailing end of the grate 24 overlying the leading end portion of the riddling grate 32.

The residue remaining on the trailing end of the lowermost grate 34 falls through a clinker hopper 36 into a water sluice 38 for transfer by a clinker chain or screw 40 to a screen 42. The screen allows the fluid component to drain therethrough while feeding the solid residue to a magnetic separator 44 which recovers ferrous metal components. The remaining solid residue of non-ferrous metals, glass, sand and other non-combustibles can be used for land fill or may be further processed for removal of other valuables, such as non-ferrous metals, before disposal.

Combustion air is drawn into the furnace and released below the grates for passage upwardly therethrough in support of combustion. The hot flue gases 50, produced during combustion, are passed in heat exchange relation with steam coils 52 located in a separate boiler but preferably located in the space above the grates with water entering at inlet 51 and leaving as steam from outlet 53. The flue gases are processed through an electrical precipitator 54 for the removal of fly ash and particulates before release from the stack 56 into the atmosphere.

Heat from the combustion of the refuse is utilized to produce steam in the boiler which can be transformed into electrical energy by means of a steam turbine-generator for the generation of power to operate the facility, leaving a vast excess of power available for sale.

Referring to FIG. 2, the grates, which form the floor on which the refuse is carried through the furnace, are constructed of a plurality of elongated grate bars 60 and 62, dimensioned to have length corresponding to the length of the grate section, with the bars arranged in side-by-side relation in each section. Flat floor plates (not shown) are supported above each bar in edge-to-edge relation to define a substantially continuous surface on which the refuse is supported. Alternate bars 60 are fixed at their ends to crosswise-extending drive beams 64 which are adapted to be actuated in reciprocal movement in the endwise direction, with means to cause the beam and its connected bars to rise during forward movement to a level above the adjacent fixed bars 62 and to return to lowered position during reverse movement, thereby to define a "walking beam" for stepwise advancement of the refuse along the grates through the furnace.

The means for guiding the drive beam and bars for movement vertically comprise inclined slide chutes fixed to longitudinally spaced-apart portions on the underside of the movable bars, having an edge slope of about 10°, and abutments which are fixed in position to be engaged by such sloping surfaces whereby the frame and movable bars rise during forward movement in response to the cam action between the sloping surface of the slide plates and fixed abutments and back down during rearward movement of the movable bar assembly. The above is shown in my co-pending application Ser. No. 000,084 filed concurrently herewith and entitled "Furnace Grating," which application is incorporated herein by reference.

To the present, the drive beam 64 has been actuated in reciprocal movement by one or more crosswise aligned hydraulic cylinders having a clevis on the end of the piston rod connected by a pin into operative engagement with the drive beam.

Misalignment and heat from the furnace transfer unendurable physical and thermal thrust loads directly back into the cylinder rod with the result that excessive wear and burnout of the seals occurs on frequent occasions, requiring removal of the drive means for replacement or repair. The problem that is raised stems from the inability to disconnect the cylinder from the drive beam without shutdown of the furnace. This resulted in interruption of the combustion operation, which not only interfered with combustion efficiency of the furnace, but also contributed to the inefficient utilization of the furnace and associated equipment. Thus the cost of operation was increased while performance was undesirably decreased.

It is an object of this invention to provide a furnace of the type described in which the transfer of damaging heat to the actuating piston and cylinder assembly is substantially eliminated; which includes means for minimizing misalignment of the operatively connected elements for transmitting reciprocal movement of the piston to the beam for movement of the grates; which prevents hot gases and fly ash or other particulates from creating a fire hazard by escape from the furnace through the drive openings in the furnace wall; and which permits replacement or repair of the drive mechanism without the need to interfere with the continuous operation of the furnace.

These and other objects and advantages of this invention will hereinafter appear and, for purposes of illustration, but not of limitation, an embodiment of the invention is shown in the accompanying drawings, in which.

Figure 3:
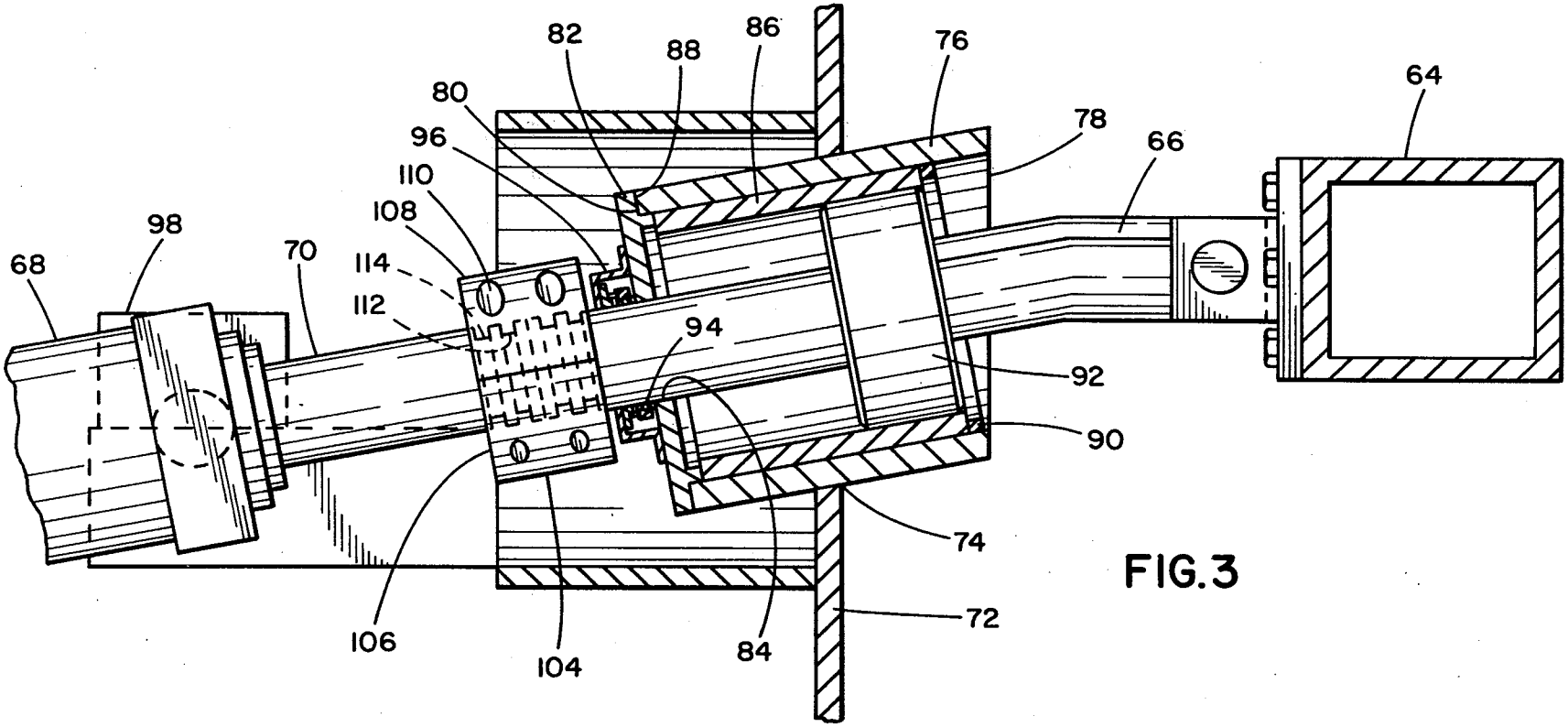
FIG. 3 is a sectional elevational view of the hydraulic drive mounted in position of use on the furnace wall in accordance with the practice of this invention.

The connection of the guide piston 66 to the actuating hydraulic cylinder 68 for conjoint movement with the piston rod 70 operative therein, is shown in FIG. 3 in which 72 is the furnace wall having an opening 74 therethrough in which the means is mounted for effecting the desired transmission of movement in accordance with the practice of this invention.

Extending through the opening 74, in sealed engagement with the furnace wall 72, is a housing cylinder 76 which is open in the end portion 78 extending into the furnace and which is closed at the end portion 80 extending beyond the outside wall of the furnace, as by a retainer end cap 82 having a central passage 84 through which the outer end portion of the guide piston 66 extends for endwise sliding movement relative thereto.

The housing assembly 76 is internally lined with a cylindrical member 86 formed of steel or other metal which resists corrosion at high temperature. The liner 86 is secured in position of use within the housing cylinder 76 between abutments 88 extending forwardly from the retainer end cap into the bore of the housing cylinder 76 and an abutment 90 fixed within the forward end portion of the housing cylinder.

A piston plug 92, having a diameter closely corresponding to the internal diameter of the liner 86, but of greater diameter than the guide piston 66, is fixed on an intermediate portion of the guide piston 66, so as to be located within the housing cylinder 76 for sliding engagement with the liner 86 during all reciprocal movement, thereby to function as a sliding guide for the piston while at the same time functioning as a seal to militate against the escape of gases and particulates from the interior of the furnace through the furnace wall opening. As such, the guide piston functions as a combined heat sink and shield and as a carrier in the connection between the beam 64 and the hydraulic cylinder piston arrangement 68–70.

The opening 84 through the retainer end cap 82 is sealed by a sealing ring 94 which is retained in position of use, in sealing engagement with the outer wall of the retainer end cap, by a seal housing 96 secured to the outer wall of the end cap.

Figure 1:
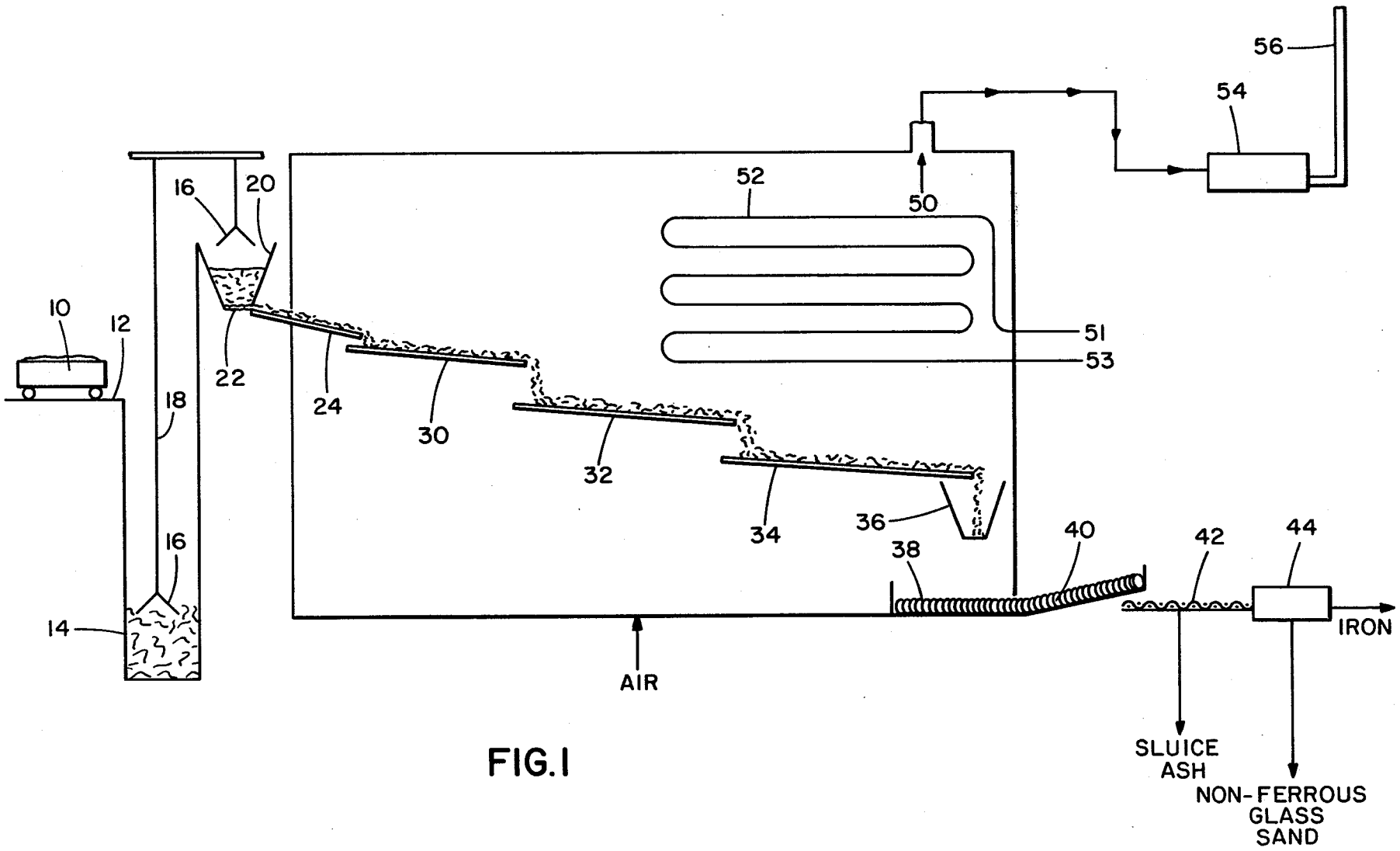
FIG. 1 is a flow diagram of a system for conversion of trash and garbage into utilizable energy, with the accompanying recovery of valuables and marked reduction in the volume of material that remains for disposal.
Figure 2:
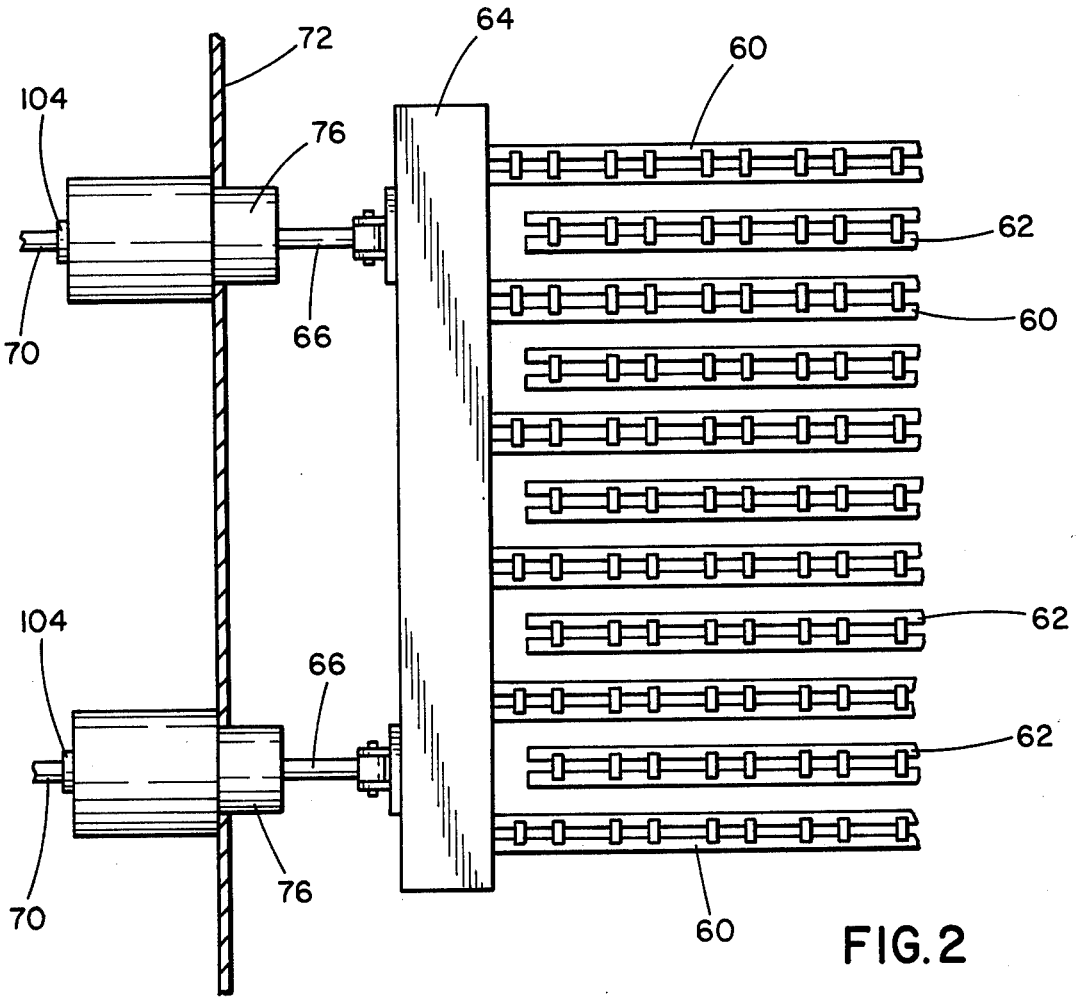
FIG. 2 is a schematic top plan view of a portion of the interior of the furnace showing the grating connected to the drive mechanism.
Figure 4:
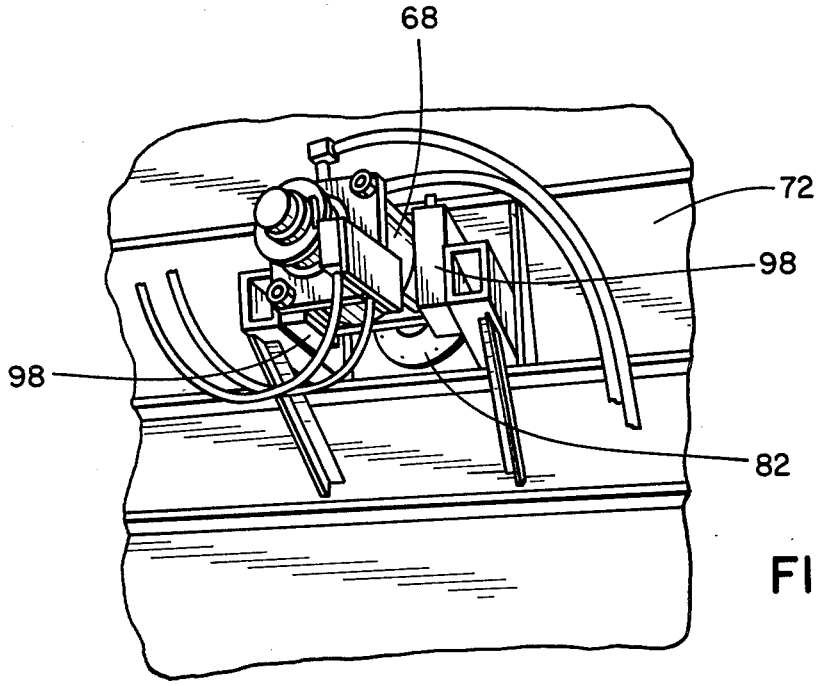
FIG. 4 is a perspective view of a portion of the outer wall of the furnace showing the drive in mounted relation.

The actuating hydraulic cylinder 68 is pivotally secured at its far end on a trunnion 98 for rocking movement thereabout with the trunnion secured in fixed relation to the outer wall of the furnace as by means of brackets 100 shown in FIG. 4 of the drawing. A bracket 102, similarly secured to the wall of the furnace, is joined to the cylinder housing (76) for support thereof.

Means are provided for releasably connecting the end portion of the piston 70 with the rearward end portion of the guide piston 66 which extends beyond the cylinder housing 76.

For this purpose, use is made of a coupler 104 formed of a pair of blocks 106 and 108 held together by bolt and nut means 110. Each section of the block is formed with axial grooves across its hollow internal surface which corresponds in contour to one half of the outer contour of the adjacent end portions of the piston 70 and guide piston 66 to define a cylindrical mating section therebetween, whenever the piston rod and guide piston are cylindrical members. The grooved portions are formed with axially-spaced-apart circumferential ribs 112 which mesh with corresponding circumferential grooves 114 in the adjacent portions of both the piston and guide rods when the ends of the rods are clamped between the two sections of the coupler. The two parts of the coupler are adapted releasably to be secured in clamping position about the intermeshed ends of the rods, as by the bolt and nut means 110 extending through offset portions of the coupler parts. Thus the driving cylinder 68 and its piston rod 70 can be disengaged from the guide piston 66 and beam 64 merely by separation of the parts of the coupler 104 to release the piston and guide rods. After the necessary repair or replacement of the cylinder and piston assembly has been effected, the piston rod 70 can then be rejoined with the guide piston 66 merely by enveloping and clamping the adjacent ends between the coupler means. In this regard, it will be understood that the intermeshing grooves and rib arrangement can be reversed to provide the grooves in the coupler and the meshing ribs in the end portions of the rods.

It will be apparent from the foregoing that means are provided for protecting the driving mechanism from the heat and fumes of the furnace thereby to prolong the useful life of the drive mechanism before replacement or repair is required. It will be apparent also that the drive mechanism can be disconnected for replacement or repair without the need to cool down the furnace as heretofore required to obtain access to the interior thereof for release of the drive.

The described mechanism also operates to guide the rod (70) in engagement with the moving beam (64) in a manner to maintain proper alignment so as to avoid distortions which have heretofore required discontinuance of operation and shutdown for replacement and repair.

It will be understood that the piston rod (70) may be replaced with other rod means mechanically actuated for reciprocal movement as by levers, cam means, rotating discs with actuating offsets operatively connected to a power source, such as an electrical motor, belt drive or the like.

It will be further understood that changes may be made in the details of construction, arrangement and operation without departing from the spirit of the invention, especially as defined in the following claims.

I claim:

1. In a combustion furnace having a grating, portions of which are movable for advancement of combustible material over the surfaces of the grating and through the furnace, means for actuating said movable grating portions in reciprocal movement comprising an elongate rod-like member extending through an opening through a wall of the furnace having an outer end portion external of the furnace wall and an inner end portion extending into the furnace, and an operative connection between the inner end portion of said rod-like member and the movable grating portions, a means external of the furnace for mechanical actuation of said rod-like member in reciprocal movement, and an operative connection between said actuating means and said rod-like member, a tubular member mounted to extend from beyond the furnace wall and through said opening in sealing relation with the furnace wall, said tubular member having a passage extending therethrough of greater cross section than the cross section of the rod-like member, said tubular member being closed at the outer end portion except for an opening for passage of the rod-like member therethrough, and a piston plug rigid with said rod-like member slidably engaged within the tubular member during reciprocal movement to guide the rod-like member in reciprocal movement.

2. A furnace as claimed in claim 1 in which the tubular member comprises a cylindrical housing and which includes a liner of cylindrical shape lining the interior of the cylindrical housing, the piston plug being in sealing engagement with the liner for separation of the housing into a forward portion contiguous with the interior of the furnace and a rearward portion separated therefrom by the piston plug.

3. A furnace as claimed in claim 2 in which the housing is open at the forward end extending into the furnace and closed at the other end, an opening through the closed end of the housing for passage of the guide piston therethrough, and sealing means secured to the housing for sealing the opening through which the guide piston extends.

4. A furnace as claimed in claim 1 which includes means externally of the furnace for connecting and disconnecting the rod-like member comprising forming the rod-like member of two sections in end-to-end relation, a clamping means formed of two sections having internal axial grooves that define a passage therebetween which correspond in dimension and shape with the ends of said rod-like member, circumferential grooves in one of the members and ribs in the other which mesh into the grooves for joinder of the adjacent ends of the guide piston and actuating rod when the two sections are interconnected thereabout.

5. A furnace as claimed in claim 1 in which the rod-like member comprises the piston rod of a fluid operated piston and cylinder assembly.

6. A furnace as claimed in claim 1 which includes spaced abutments within the passage of said tubular member in the path of said piston plug to define the extent of reciprocal movement.

7. A furnace as claimed in claim 1 in which the tubular member is formed of a metal having good heat conductivity for operation as a heat sink as well as for guidance of said rod-like member.

* * * * *